United States Patent [19]

Nakako et al.

[11] Patent Number: 4,565,622

[45] Date of Patent: Jan. 21, 1986

[54] METHOD OF LIQUEFYING BROWN COAL

[75] Inventors: Yukio Nakako, Takarazuka; Tetsuo Matsumura, Kobe; Toshio Ozawa, Kobe; Kaizaburo Saito, Kobe; Shin-ichi Katsushima, Kobe; Shin-ichi Oya, Kobe; Toshiaki Okui, Kobe; Yutaka Mito, Ibaraki; Osamu Okuma; Tomoji Takahashi, both of Kobe, all of Japan

[73] Assignees: Kabushiki Kaisha Kobe Seikosho, Kobe; Mitsubishikaseikogyo Kabushikikaisha, Tokyo; Idemitsukosan Kabushiki Kaisha, Tokyo; Aziaseiyu Kabushiki Kaisha, Tokyo; Nippon Kattan Ekika Kabushiki Kaisha, Tokyo, all of Japan

[21] Appl. No.: 550,122

[22] Filed: Nov. 9, 1983

[30] Foreign Application Priority Data

Dec. 15, 1982 [JP] Japan ..... 57-220970

[51] Int. Cl.[4] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,540,995 | 11/1970 | Wolk et al. | 208/10 |
| 3,726,785 | 4/1973 | Keller et al. | 208/8 LE |
| 3,841,991 | 10/1974 | Cohen et al. | 208/10 X |
| 4,094,766 | 6/1978 | Gorin | 208/10 |
| 4,164,466 | 8/1979 | Baldwin et al. | 208/8 LE |
| 4,189,372 | 2/1980 | Baldwin et al. | 208/8 LE |
| 4,192,653 | 3/1980 | Giannetti et al. | 208/10 X |
| 4,303,498 | 12/1981 | Chikata et al. | 208/8 LE X |
| 4,318,797 | 3/1982 | Jager et al. | 208/8 LE |
| 4,364,817 | 12/1982 | Anderson et al. | 208/8 LE |
| 4,372,838 | 2/1983 | Kulik et al. | 208/10 |
| 4,391,699 | 7/1983 | Rosenthal | 208/10 X |
| 4,400,263 | 8/1983 | Kydd et al. | 208/10 |
| 4,464,245 | 8/1984 | Hodek | 208/10 |

*Primary Examiner*—D. E. Gantz
*Assistant Examiner*—William G. Wright
*Attorney, Agent, or Firm*—Oblon, Fisher, Spivak, McClelland & Maier

[57] ABSTRACT

A method for the liquefaction of brown coal which comprises effecting primary hydrogenation at a temperature and pressure sufficient to promote the efficient hydrogenation of a slurry prepared by adding an iron-based catalyst and a slurrying solvent to brown coal; distilling all or a portion of the primary hydrogenation product, whereby a naphtha fraction, a middle distillate oil fraction, a heavy distillate oil fraction and a distillation residue are produced; recycling a portion of said middle distillate oil, said heavy distillate oil fraction and said distillation residue to said primary hydrogenation step as the slurrying solvent; removing ash from the remaining portion of the distillation residue, thereby separating the same into an insoluble fraction containing ash, insoluble organic matter or a mixture thereof, and a soluble fraction as a solution in said solvent; and feeding said soluble fraction and said middle and heavy distillate fractions, to a fixed-bed column reactor packed with a molybdenum-based catalyst for secondary hydrogenation at a temperature and pressure sufficient to promote the efficient hydrogenation thereof; and separating the naphtha fraction from the secondary hydrogenation product and recycling all or a portion of the remainder to said primary hydrogenation step as the slurrying solvent therefor.

18 Claims, 6 Drawing Figures

METHOD OF LIQUEFYING BROWN COAL

BACKGROUND OF THE INVENTION

1. Field of the Invention

This invention relates to the art of brown coal liquefaction, especially to the art of effecting hydrogenolysis (hereinafter referred to as "hydrogenation") of pulverized brown coal in the slurry form. More particularly, it relates to a method of increasing and recovery of naphtha and other oil fractions by selecting, as the slurrying solvent, a solvent suited for high-efficiency hydrogenation and conducting the hydrogenation in two steps.

2. Description of the Prior Art

In the two-step hydrogenation process known as a method of liquefying brown coal, the first hydrogenation (hereinafter referred to as "primary hydrogenation") step comprises blending pulverized brown coal, a slurrying solvent and a hydrogenation catalyst with one another and subjecting the mixture to reaction with hydrogen at high temperature and high pressure. It has already been confirmed that the hydroliquefaction efficiency is much influenced by the adequacy for hydrogenation of the slurrying solvent used. If the slurrying solvent is inadequate for hydrogenation, the SRC (solvent-refined coal) formed by hydrogenolysis will contain structures with advanced ring condensation and, in extreme cases, will lead to the phenomenon of coking. It has also been confirmed that the use of a slurrying solvent suired for high-efficiency hydrogenation increases the recovery of oil fraction in the primary hydrogenation and the yield of fractions corresponding to the light distillate oil and further results in an increase in the proportion of benzene-soluble components as a result of promoted hydrogenation of the resulting SRC. The use of a high-grade catalyst as the hydrogenation catalyst may of course help compensate for the disadvantage of a slurrying solvent which is inadequate for hydrogenation. Due to the strong demand from the cost viewpoint, however, inexpensive iron-based catalysts, for instance $Fe_2O_3+S$, are generally used as the primary hydrogenation catalysts and at the same time a slurrying solvent not well-suited for hydrogenation is in use. Under these circumstances, the hydroliquefaction efficiency necessarily remains at a low level. The same also applies to the second step hydrogenation, where a high-grade molybdenum-based catalyst is generally used. In fact, however, the slurrying solvent used therein is not very adequate for hydrogenation and therefore the particular technological constitution, namely the addition of a secondary hydrogenation step, cannot produce the intended effect to the full.

The hydroliquefaction reaction is supposed to proceed in the manner of pyrolysis (thermal degradation) of brown coal to lower-molecular-weight compounds and stabilization of radicals formed thereby by reaction with hydrogen. It is also known that the yield of oil fraction given by liquefaction depends on the balance between the rate of pyrolysis and the rate of hydrogen supply. At a relatively high rate of hydrogen supply, the oil fraction yield is high, whereas a slow hydrogen supply rate results in an increase in the yield of heavy distillate oil fraction but in a decrease in the yield of oil fraction. In any case, however, in the current situation where the slurrying solvent is in itself inadequate for hydrogenation, it is natural that an increase in the hydrogen supply rate cannot directly produce the effect of increasing the oil fraction yield.

Therefore, a need continues to exist for a method of liquefying brown coal which uses a slurrying solvent which is adequate for high-efficiency hydrogenation in each of the primary and secondary hydrogenation steps, thereby increasing the efficiency of hydrogenation in each hydrogenation step, and which enables the recovery of oil fractions in good yield.

SUMMARY OF THE INVENTION

Accordingly, it is an object of the present invention to provide a method of liquefying brown coal which uses a slurrying solvent adequate for high-efficiency hydrogenation in each of the primary and secondary hydrogenation steps, thereby increasing the hydrogenation efficiency in each hydrogenation step, and which enables recovery of oil fractions in good yields.

It is also an object of the present invention to provide a method of liquefying brown coal not only at increased rates of recovery of oil fractions but also at low running cost.

Moreover, it is also an object of this invention to provide a brown coal liquefaction method which produces further improvement in the recovery of oil fractions by establishing the reaction conditions in each of the primary and secondary hydrogenation steps.

According to the present invention, the foregoing and other objects are attained by providing a process for the liquefaction of brown coal which comprises effecting primary hydrogenation at a temperature and pressure sufficient to promote the efficient hydrogenation of a slurry prepared by adding an iron-based catalyst and a slurrying solvent to brown coal; distilling all or a portion of the primary hydrogenation product, whereby a naphtha fraction, a middle distillate oil fraction, a heavy distillate oil fraction and a distillation residue are produced; recycling a portion of said middle distillate oil fraction, said heavy distillate oil fraction and said distillation residue to said primary hydrogenation step as the slurrying solvent; removing ash from the remaining portion of the distillation residue, thereby separating the same into an insoluble fraction containing ash, insoluble organic matter or a mixture thereof, and a soluble fraction as a solution in said solvent; and feeding said soluble fraction and said middle and heavy distillate fractions, to a fixed-bed column reactor packed with a molybdenum-based catalyst for secondary hydrogenation at a temperature and pressure sufficient to promote the efficient hydrogenation thereof; and separating the naphtha fraction from the secondary hydrogenation product and recycling all or a portion of the remainder to said primary hydrogenation step as the slurrying solvent therefor.

BRIEF DESCRIPTION OF THE DRAWINGS

Other objects, features and attendant advantages of the present invention will be more fully appreciated as the same becomes better understood from the following detailed description when considered in connection wirh the accompanying drawings in which like reference characters designate like or corresponding parts and wherein.

DETAILED DESCRIPTION OF THE PREFERRED EMBODIMENTS

The brown coal liquefaction method according to the present invention, in principle, involves the above steps and may be modified in various ways by adding an additional step or steps or by modifying the mode of operation in any of the steps, for instance. In the description which follows, the basic process is first described, whereas those additional steps and modifications in design and mode of practice which are recommendable will be described elsewhere. In any case, however, these descriptions are only illusrrative of typical matters but are by no means limitative of the present invention. Accordingly, it is to be noted that any change or modification without departing the spirit of the invention disclosed herein will fall within the scope of the present invention on.

Figure 1:
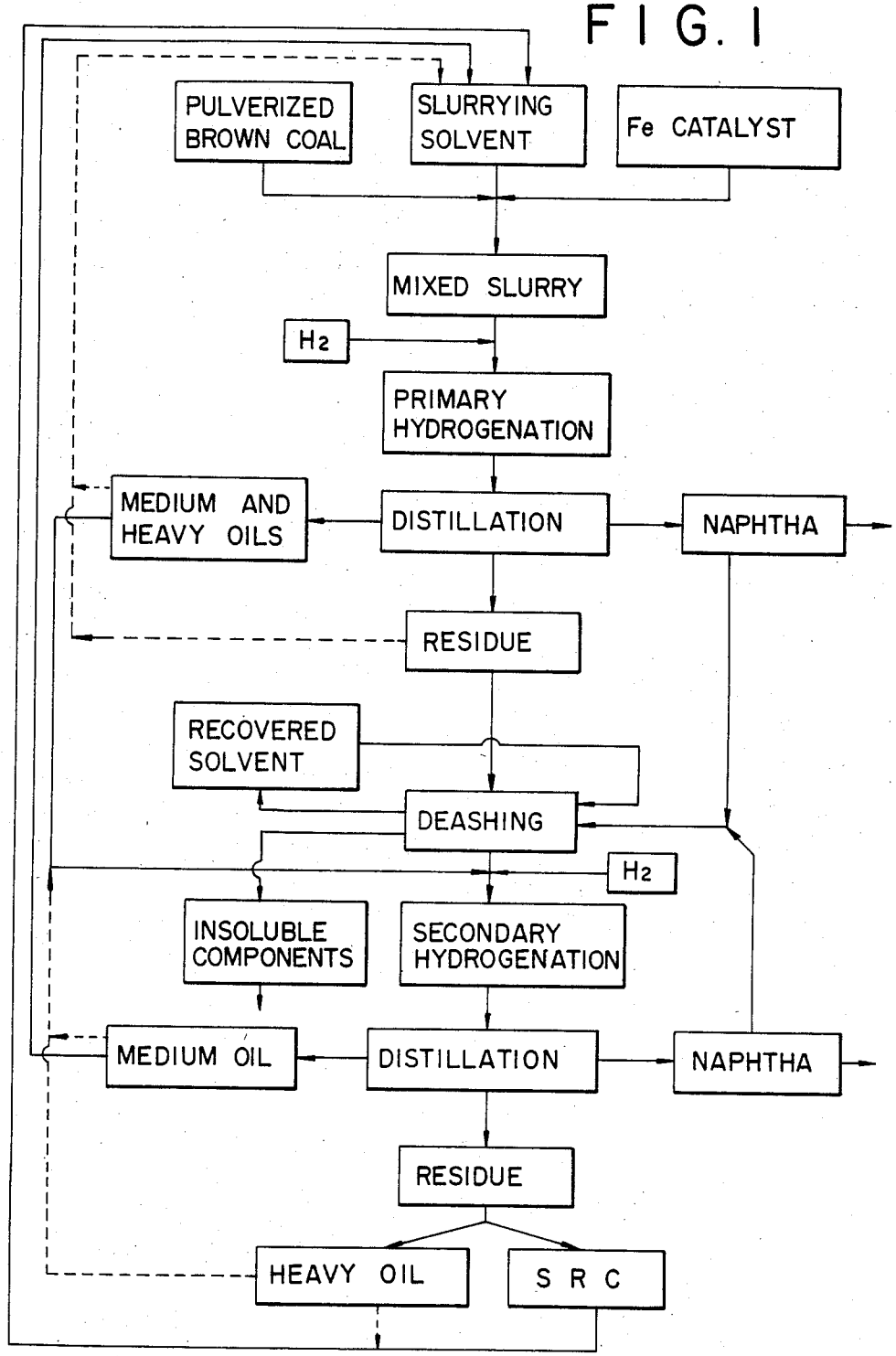
FIG. 1 is a flow diagram illustrative of the basic process according to the present invention.
Figure 2:
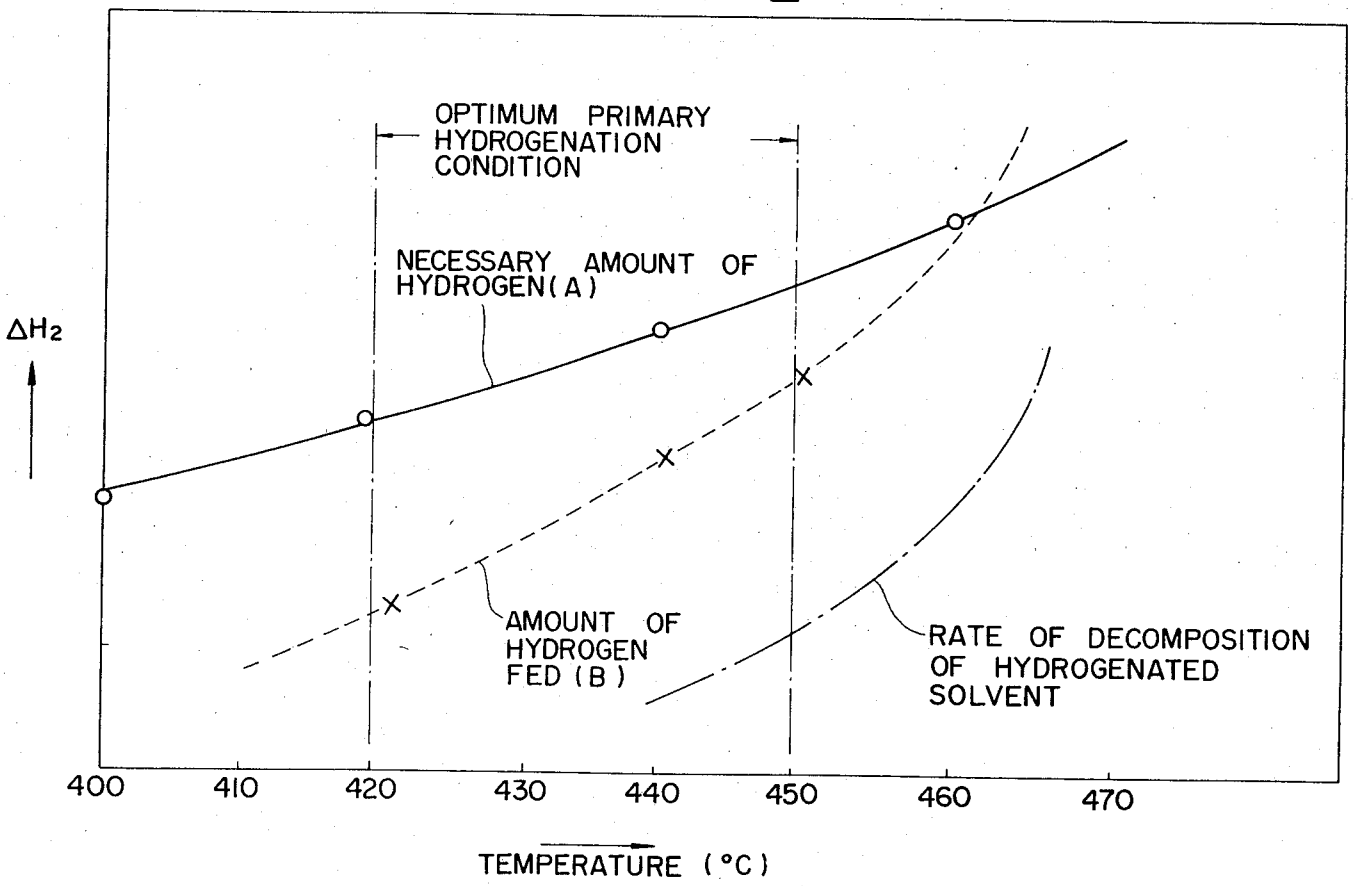
FIG. 2 is a flow diagram illustrative of an embodiment of the present invention.

FIG. 1 is a block diagram illustrating the basic process. In step [I], pulverized brown coal is mixed with a iron-based catalyst and a slurrying solvent which is separated and recycled from the secondary hydrogenation product as mentioned hereinbelow. The resulting mixed slurry is subject to primary hydrogenation at a temperature of 420°–460° C.' (preferably about 430°–450° C.) and a pressure of 100–300 atmospheres (preferably about 150–200 atmospheres). The iron-based catalyst (e.g. $Fe_2O_3+S$) used herein promotes the addition of hydrogen to brown coal. Hydrogen first reacts with polycyclic aromatic hydrocarbons contained in brown coal under the action of the iron-based catalyst and is then transferred as donor hydrogen to radicals formed by pyrolysis. The slurrying solvent absorbs hydrogen in the hydrogenation step and then supplies this hydrogen to the mentioned above radicals so as to stabilize the radicals. The recycling use of a secondary hydrogenation product can cause these hydrogenation reactions to proceed efficiently. The hydrogenation conditions have been established as above because the hydrogenation and pyrolysis reactions canno proceed efficiently at temperatures and pressures below the above-mentioned respective lower limits while, under severe conditions exceeding the above upper limit values, the recyling use of the solvent results in a relative decrease in the hydrogen supply by the solvent, which will lead to the problem of coking. In this manner, it is imporrant for efficient progress of hydrogenolysis that the balance between the amount of hydrogen (A) required to stabilize radicals formed by pyrolysis and the amount of hydrogen (B) supplied via the solvent should be maintained in an optimum state. For especially easily pyrolyzable brown coal, the relationship between both the amounts, when seen, for instance, from the viewpoint of the influence of temperature, can be illustrated as shown in FIG. 2. Thus, in the lower temperature region, the required hydrogen amount (A) is larger as compared with the amount of hydrogen supplied (B), but the tendency of the supplied hydrogen amount (B) to increase with the rise in temperature is greater than that of the required amount of hydrogen (A) and, at temperatures exceeding 460° C., the relation between them becomes reversed. On the other hand, the rate of decomposition of the hydrogenated solvent rapidly increases when the temperature exceeds about 450°–460° C., as also shown in FIG. 2. In this condition, hydrogenolysis of polycyclic aromatics, which are especially important among the solvent components because of their hydrogen supplying capacity, becomes significant. Therefore, repeated use of the solvent results in decrease in the content of effective components and eventually in coking. Accordingly, in the practice of the present invention, the reaction temperature is suppressed at a level of 460° C. or below so as to avoid the occurrence of coking. These temperature conditions, however, may cause a deficiency in the supplied hydrogen amount (B) relative to the required hydrogen amount (A), as mentioned hereinabove, hence a deficiency in the amount of solvent, due to polymerization of pyrolytically formed radicals with solvent components or of said radicals with one another which makes the liquefaction product and the solvent heavier. To cope with such problem, the deficiency in th supplied hydrogen amount (B) is covered by the recycling use of a secondary hydrogenation product having great hydrogen-supplying capacity (the whole or part of the remainder after separation of a naphtha fraction, hence of the middle distillate oil, heavy distillate oil, etc.) as the slurrying solvent, as mentioned hereinbelow. At reaction temperatures below 420° C., however, the amount of supplied hydrogen (B) cannot be incrased to a sufficient extent even when the above secondary hydrogenation product is used, hence the problem of the product and solvent becoming heavier cannot be avoided. The concentration of pulverized brown coal and the level of addition of the catalyst in the primary hydrogenation are not particularly limited. Generally, however, the brown coal concentration is in the range of 25–35 percent by weight and the level of addition of the catalyst is in the range of 1–5 percent by weight in most cases.

The primary hydrogenation product is transferred to step [II] and subjected there to distillation and thereby separated into a naphtha fraction, a middle distillate oil fraction, a heavy distillate oil fraction and an SRC-containing distillation residue. The naphtha fraction is recovered as a liquid product. Part of rhe middle distillate oil fraction, heavy distillate oil fraction and disillation residue is recycled as the slurrying solvent for the initial primary hydrogenation (step [III]). Since the residue containing solvent-refined coal (hereinafter abbreviated as "SRC") in high concentratin is to be subjected to the subsequent secondary hydrogenation, it is the middle and heavy distillation oil fractions alone that are generally recycled as the slurrying solvent for primary hydrogenation. In some cases, the heavy distillate oil fraction is contaminated with SRC or is rather contained in SRC. Such fraction can also be recycled as the slurrying solvent without producing any problem. Furthermore, the middle distillate oil fraction alone may be recycled as the slurrying solvent for primary hydrogenation as the case may be. In further cases, not the whole of the primary hydrogenation product but part thereof is subjected to distillation and the distillate fractions are separated in the manner mentioned above, and the distillation residue thus obtained, together with the undistilled portion, is subjected to the next step [IV].

The distillation residue subjected to step [IV] contains, as mentioned above, SRC and in some cases SRC and a heavy fraction. Generally, it also contains impurities originating from the brown coal or catalyst (e.g. ash, insoluble organic substances). These insoluble components are removed by the conventional method or an adequate modification thereof and the soluble components alone, together with the remaining portion of the above-mentioned middle distillate oil fraction and/or heavy distillate oil fraction, are sent to the secondary hydrogenation step. Such middle distillate oil fraction and/or heavy distillate oil fraction may be regarded as the slurrying solvent in the secondary hydrogenation. The removal of ash is performed, for example, by using a solvent. The use of the naphtha fraction separated from the above-mentioned primary hydrogenation product or the naphtha fraction separated from the secondary hydrogenation product mentioned later as the deashing solvent is not only favorable for efficient ash removal but is also advantageous in that benzene-insolubles in the distillation residue, especially in SRC can be removed efficiently. Thereafter, this deashing solvent may be regenerated by filtration and subsequent distillation and can be recycled again as the deashing solvent. Furthermore, the reuse of the regenerated deashing solvent as the slurrying solvent in step [I] or [IV] in an embodiment described herein also falls within the scope of the present invention.

The secondary hydrogenation step is a step in which those components remaining which have high-molecular-weight are again subjected to hydrogenolysis. The raw material in this step is, as mentioned previously, the distillation residue (soluble fraction after ash removal) from the primary hydrogenation product. This is subjected to the secondary hydrogenation together with the middle and/or distillate oil fraction, as also mentioned hereinabove. This hydrogenation is carried out on a fixed-bed packed with a Mo-based catalyst at a temperature of 350°–450° C. (preferably 360°–420° C.) and a pressure of 50–250 atmospheres (preferably 100–150 atmospheres). Examples of the Mo-based catalyst are Ni-Mo on alumina and Co-Mo on alumina. Such a Mo-based catlyat is selected as the catalyst for secondary hydrogenation because Mo-based catalysts show good durability in hydrogenolysis of heavy distillate oil fractions and are excellent especially in desulfurization and denitrification activities. The reasons why this hydrogenation is carried out on a fixed bed catalyst are that the steady-state operational procedure is easier as compared with other reactors such as ebullated-bed ones, that the product is contaminated to lesser extent with ash and foreign matters due to catalyst breakage or disintegration and especially that the load in the ash removal step due to bottom recycling is small. Moreover, fixed-bed reactors are widely used in direct desulfurization of heavy oil, for instance, and are highly reliable. The reasons why the above-mentioned hydrogenation conditions are employed are almost the same as in the case of the primary hydrogenation. Thus, when the temperature and pressure are below the respective lower limit values, the hydrogenation and pyrolysis reactions do not proceed to a sufficient extent. When they exceed the respective upper limit values, the hydrogenolysis of the solvent becomes significant and eventually presents the problem of coking. However, the reaction conditions are, in general, milder than those of the primary hydrogenation. In this secondary hydrogenation step, the heavy oil fraction, SRC and middle distillate oil fraction unsatisfactorily degraded or remaining undegraded are again subjected to hydrogenolysis to give light oil fractions. Therefore, distillation in step [V] of this secondary hydrogenation product gives, as a result of the reaction, a low-boiling naphtha fraction and further a middle distillate oil fraction. Further distillation of the residue can separate the same into a heavy distillate oil fraction and SRC. The naphtha fraction thus obtained is recovered as a product, and part thereof can be used as the deashing solvent, as mentioned hereinabove. The whole or part of the remainder after separation of the naphtha fraction, with or without further fractionation into a middle distillate oil fraction, a heavy distillate oil fraction and SRC, is recycled to step [I] as the slurrying solvent for primary hyrogenation and in this manner subjected again to primary and secondary hydrogenation via steps [I]–[IV]. Since said recycling fraction has been hydrogenated to a sufficient extent in the secondary hydrogenation step, the fraction is highly adequate for use as the slurrying solvent and produces the secondary effect of causing the hydrogenolysis of pulverized brown coal to proceed highly efficiently.

Examples of the form of the slurrying solvent to be recycled for the primary hydrogenation from step [V] are (a) a middle distillate oil fraction alone, (b) a heavy distillate oil fraction alone, (c) a mixture of a middle distillate oil fraction and a heavy distillate oil fraction, (d) an SRC-containing heavy distillate oil fraction and (e) an SRC-containing distillation residue, among others. Each of them has been confirmed to be a good slurrying solvent. Part of such slurrying solvent may be recycled to the secondary hydrogenation step. In that case, the forms (a), (b) and (c) mentioned above are recommendable and each can promote the secondary hydrogenation.

Figure 3:
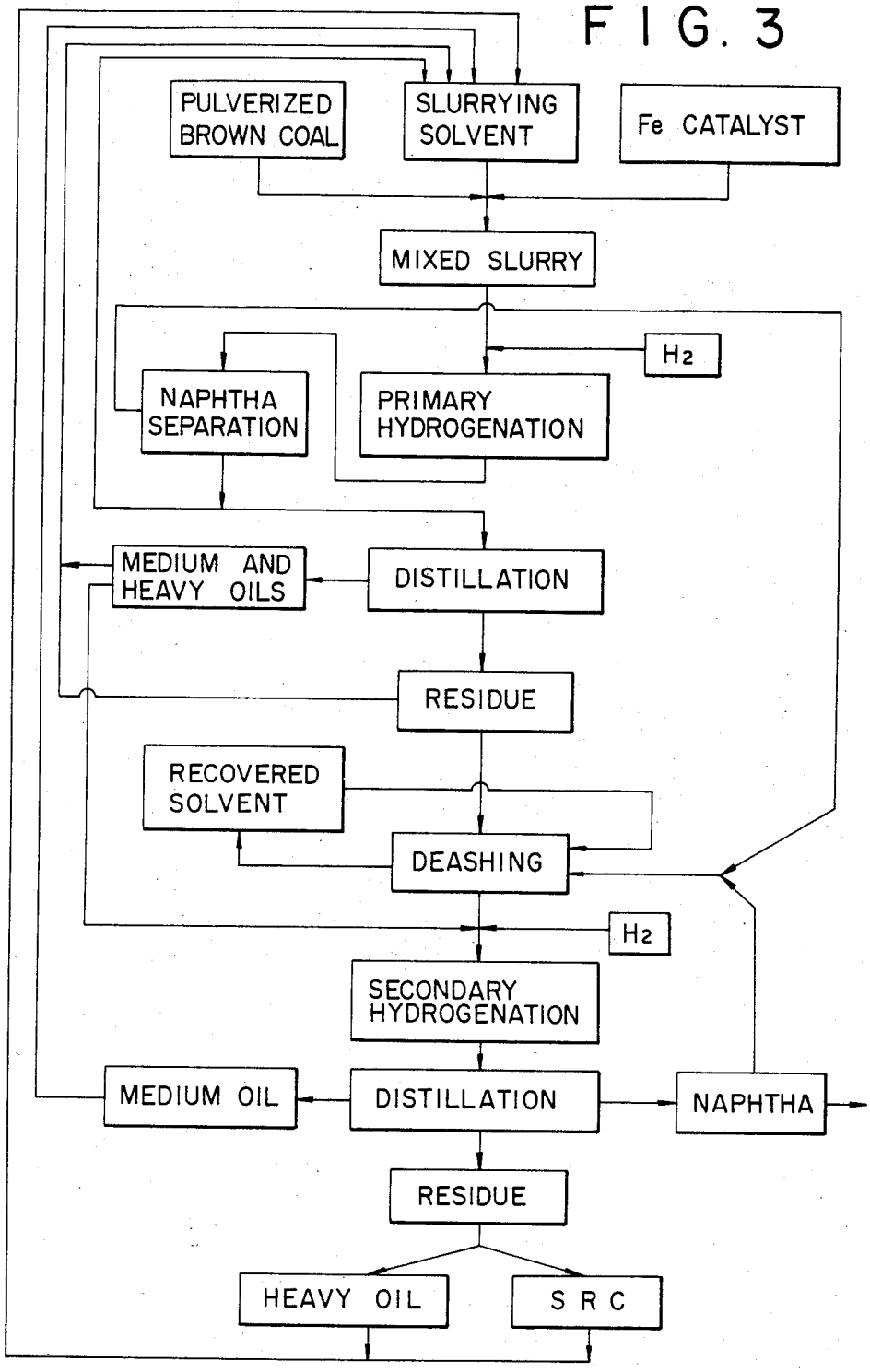
FIG. 3 is a flow diagram illustrative of another embodiment of the present invention.

In the above, the basic process in accordance with the present invention has been described. There may be made various modifications. In one modified process, as shown in FIG. 3, a naphtha fraction alone is recovered in advance prior to the distillation of the primary hydrogenation product in step [II] and used as the deashing solvent (and part thereof is recovered as a product as necessary) and the primary hydrogenation product remaining afrer separation of the naphtha fraction is divided into two portions, one portion being recycled as the slurrying solvent for primary hydrogenation in step [I] and the other being subjected to the above-mentioned distillation in step [II]. The above-modified process is employed for the purpose of securing the necessary amount of slurrying solvent to be returned to the primary hydrogenation step. The separation of naphtha fraction can be performed by a simple and easy technique such as flash distillation, and part of the remainder is directly recycled to the primary hydrogenation step. In this manner, the slurrying solvent can be secured in a sufficient amount and the process in accordance with the present invention can thus be further stabilized.

Figure 4:
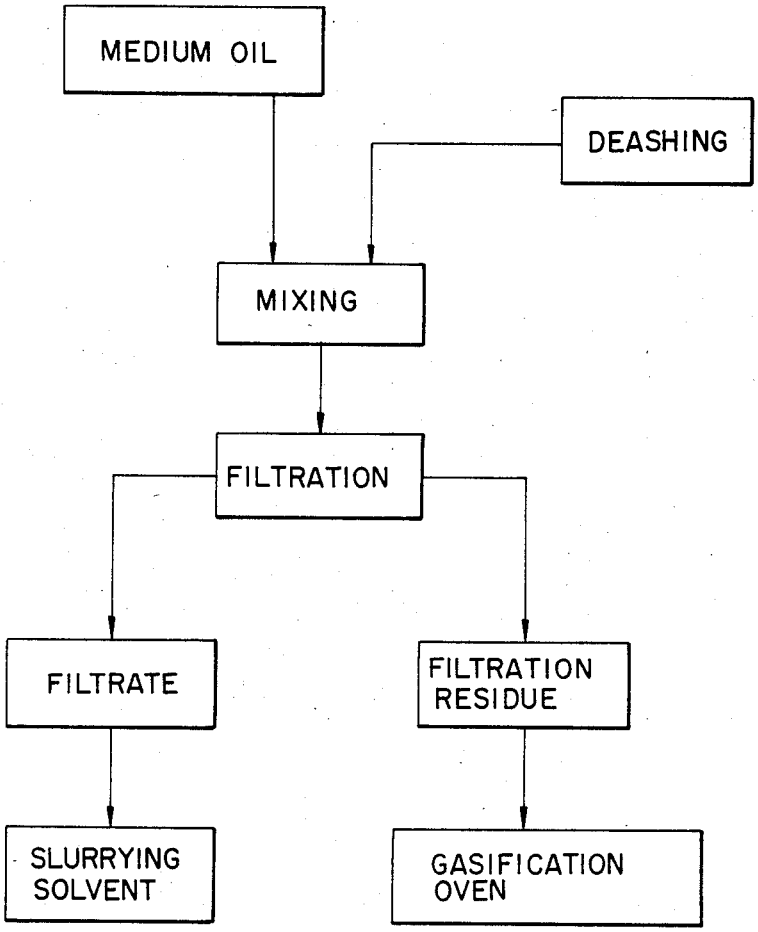
FIG. 4 is a flow diagram illustrative of a partial modification of the process according to the present invention.

FIG. 4 is a process flowchart illustrating the system of treating the insoluble matter obtained in the step of ash removal. Said insoluble matter contains insoluble organic substances, as mentioned above. More specifically, the insoluble organic substances include preasphaltene and high-molecular-weight asphaltene, with char and inorganic substances (ash, catalyst for primary hydrogenation, etc.) being present in admixture there-with. Addition thereto of the middle distillate oil fraction obtained from the primary hydrogenarion product and/or the middle distillate oil fraction obtained from the secondary hydrogenarion product followed by mixing gives a slurry. Upon settling or filtration of this slurry, there are obtained a supernatant or filtrate with the above-mentioned preasphaltene and high-molecular-weight asphaltene dissolved therein and a solid consisting of insoluble components. The preasphaltene and high-molecular-weight asphaltene contained in the supernatant or filtrate can be rendered lighter by recyling as the slurrying solvent to be used in step [I] or, if necessary, as the slurrying solvent to be used in step [IV]. On the other hand, hydrogen for hydrogenation can be recovered from the insoluble matter thus reseparated by feeding the same to a gasifying furnace so as to gasify the remaining hydrocarbons.

In the above, each step of the process to be employed in accordance with the present invention has been described. It has been found that, in the reuse of the middle distillate oil fraction, heavy distillate oil fraction and distillation residue in such process, especially in the reuse thereof as the slurrying agent for secondary hydrogenation, care should be used so as to increase the brown coal liquefaction efficiency, as mentioned in the following. SRC, the raw material in the secondary hydrogenation, is rich in substances remaining unliquefied in the primary hydrogenation. Their reactivity is considerably low, and the catalyst poison content is higher as compared with the raw material in the primary hydrogenation. Under these circumstances, it is necessary, for the achievement of a satisfactory secondary hydrogenolysis efficiency, to dissolve the raw material SRC to a sufficient extent in a slurrying solvent having an adequate distillation range (generally 250°–450° C. and bring the same into contact with hydrogen gas and the above-mentioned fixed-bed catalyst in an efficient manner. Since the recycling use of the distillate fractions from the second hydrogenation product as the slurrying solvent is also involved in the present invention, it is feared that the solvent could be hydrogenated in the secondary hydrogenation step and the aromatic carbon number index as defined by the formula given below would decrease, hence the solubility of SRC would decrease.

Aromatic carbon number index =

$$\frac{\text{Number of aromatic ring carbon atoms}}{\text{Number of aromatic ring carbon atoms} + \text{Number of side chain carbon atoms}}$$

The result would be such that not only the hydrogenolysis efficiency in the secondary hydrogenation step would become unsatisfactory but also the insoluble matter would adhere to and accumulate on the inside wall of process pipings and/or the fixed catalyst bed and block the same. Therefore, in the course of repetition of the secondary hydrogenation reaction, a situation would be encountered where the recycling use of the medium distillate oil fraction and so on separated from the secondary hydrogenation product would not be entirely favorable. It is thus necessary to stop the recycling at an adequate stage or to add a heavy distillate fraction and/or SRC, for instance, so as to render the recycling matter adequate for reuse. The present inventors employed the above aromatic carbon number index (fa) as an index therefor and first determined the lower limit value thereof to be regarded as a criterion.

Figure 5:
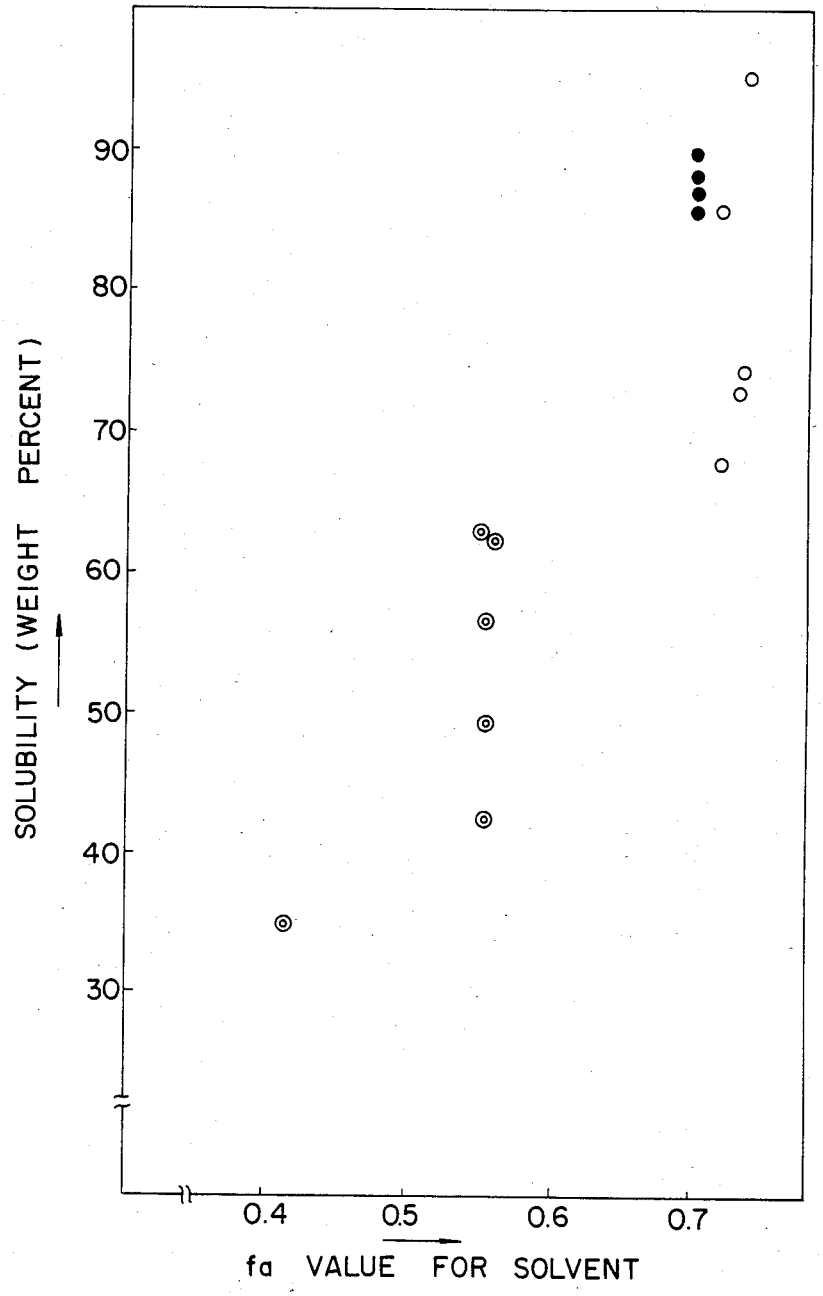
FIG. 5 is a graphic representation of the relationship between the fa value of the solvent and the solubility.

FIG. 5 illustrates the relationship between the fa value of the slurrying solvent and solubility of SRC therein [raw material SRC/(raw material SRC+insoluble matter)×100]. In the figure, the symbols used respectively indicate the results for the following cases:

○: Deashing of SRC-A with recycle solvent No. 1;
●: Deashing of SRC-B with recycle solvent No. 1;
◎: Deashing of SRC-B with recycle solvent No. 2;
◉: Deashing of SRC-B wirh recycle solvent No. 3.

As is clear also from FIG. 5, when the fa value of the slurrying solvent decreases below about 0.4, the solubility of SRC decreases markedly. It has thus been found that the slurrying solvent to be returned to the secondary hydrogenation step in accordance with the present invention should desirably be not less than about 0.4. When said value is not less than 0.5, more favorable solubility can result, so that the character of said solvent as a hydrogen donor can be retained and the degree of hydrogenolysis in the secondary hydrogenation step can be maintained at a favorable level.

Figure 6:
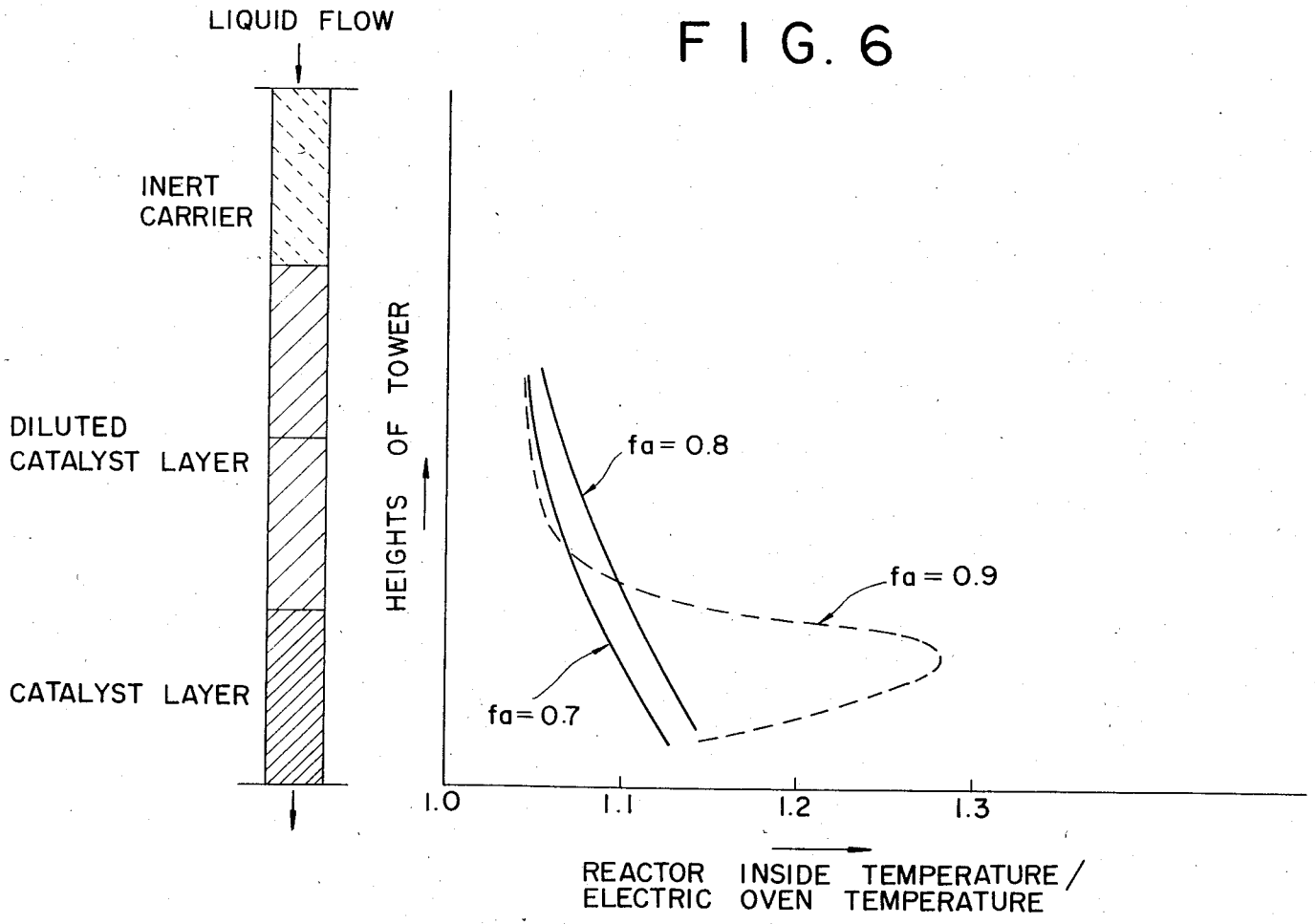
FIG. 6 is a graphic representation of the influence of the aromaric carbon number index as a parameter on the accuracy of temperature control.

On the other hand, the investigation as to where the upper limit for the fa value should be fixed has indicated that, as shown in FIG. 6, the reactor column inside temperature rises abnormally at an excessively high fa value and as a result the reaction temperature control becomes difficult. The cause is supposedly that, at an excessively high fa value, the solvent takes up a large amount of hydrogen and the heat generated thereby causes the temperature rise. Best results ar obtained if the aromatic carbon number index is not greater than about 0.8. Therefore, in using the middle distillate oil fraction and heavy distillate oil fraction in admixture, it is recommended thta the fa value should be adjusted to a value within an adequacy range by controlling the ratio therebetween.

The present invention will be further illustrated by certain examples and references which are provided for purposes of illustration only and are not intended to limit the present invention.

EXAMPLE 1

In accordance with the flowchart shown in FIG. 1, two-step hydrogenation of brown coal was carried out under the following conditions:

Primary hydrogenation:
$Fe_2O_3$ : 1.5 weight percent
Reaction: 425° C., 200 atmospheres
Secondary hydrogenation:
Catalyst: Ni-Mo
LHSV (space velocity): 1 $hr^{-1}$
Reaction: 360° C., 250 atmospheres Table 1 gives the SRC recovery rate data and the naphtha recovery rate data. In Run No. 1 (an example of the embodiment of the invention), the primary hydrogenation residue and the secondary hydrogenation residue oil were combinedly used as the slurrying solvent for primary hydrogenation. In Run No. 2 (Comparative Example), the middle distillate oil fraction from the primary hydrogenation product was used alone as the slurrying solvent. From the results, it is particularly noticeable that, in the example according to the invention, the SRC recovery rate decreased and the oil recovery rate increased, whereby the hydroliquefaction efficiency was markedly increased.

TABLE 1

| Slurrying solvent | No. 1 Primary hydrogenation product solvent plus secondary hydrogenation residue | No. 2 Primary hydrogenation product solvent alone |
|---|---|---|
| SRC recovery rate* | 37.7 | 52.6 |
| Solvent recovery rate* | 26.2 | 14.0 |
| Naphtha recovery rate* | 11.5 | 10.2 |
| $C_1$–$C_4$ recovery rate* | 6.0 | 5.0 |
| $H_2O$ recovery rate* | 11.9 | 12.3 |
| $CO_2$ + CO recovery rate* | 11.0 | 10.2 |
| Δ $H_2$ recovery rate* | 4.0 | 3.9 |

*Percent by weight based on dried coal exclusive of inorganic matter.

EXAMPLE 2

For confirmation of the effect of the process shown in FIG. 3, one-step hydrogenation was performed in accordance with the flowchart shown in FIG. 3 (Run No. 3) or in FIG. 1 (Run No. 4). The results obtained are shown in Table 2. The reaction was carried out at 430° C. and 150 atmospheres.

TABLE 2

| Slurrying solvent | No. 3 Primary hydrogenation product solvent plus secondary hydrogenation residue | No. 4 Primary hydrogenation product solvent alone |
|---|---|---|
| SRC recovery rate* | 35.2 | 49.8 |
| Solvent recovery rate* | 26.6 | 17.2 |
| Naphtha recovery rate* | 12.0 | 9.6 |
| $H_2O$ recovery rate* | 11.1 | 12.2 |
| $C_1$–$C_4$ recovery rate* | 7.3 | 5.0 |
| $CO_2$ + CO recovery rate* | 12.2 | 10.3 |
| Δ $H_2$ recovery rate* | 4.3 | 3.9 |

*Percent by weight based on dried coal exclusive of inorganic matter.

As shown in Table 2, the naphtha recovery rate in Run No. 3 was significantly higher.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method of liquefying brown coal which comprises:

[I] effecting a primary hydrogenation at a temperature and pressure sufficient to promote the efficient hydrogenation of a slurry prepared by adding an iron-based catalyst and a slurrying solvent to brown coal;

[II] distilling all or a portion of the primary hydrogenation product, whereby a naphtha fraction, a middle distillate oil fraction, a heavy distillate oil fraction and a distillation residue are produced;

[III] recycling a portion of said middle distillate oil fraction, said heavy distillate oil fraction and said distillation residue to said primary hydrogenation step as the slurrying solvent;

[IV] removing ash from the remaining portion of the distillation residue, thereby separating the same into an insoluble fraction containing ash, insoluble organic matter or a mixture thereof, and a soluble fraction as a solution in said solvent; and feeding the soluble fraction and the remainder of said middle and heavy distillate fractions to a fixed-bed column reactor packed with a molbdenum-based cayalyst for a secondary hydrogenation at a temperature and pressure sufficient to promote the efficient hydrogenation thereof, wherein a slurrying solvent having an aromatic carbon number index within the range of about 0.4 to 0.8 is used in said secondary hydrogenation; and

[V] separating the naphtha fraction from the secondary hydrogenation product and recycling all or a portion of the remainder to said primary hydrogenation step as the slurrying solvent therefor.

2. The brown coal liquefaction method according to claim 1, wherein the temperature and pressure of said primary hydrogenation are about 420° to 460° C. and about 100 to 300 atmospheres, respectively, and the temperature and pressure of said secondary hydrogenation are about 350° to 450° C. and about 50 to 250 atmospheres, respectively.

3. The brown coal liquefaction method according to claim 1, wherein, after step [I], a naphtha fraction is separated from the primary hydrogenation product and a part of the remaining primary hydrogenation product after separation of said naphtha fraction is recycled to the primary hydrogenation step as the slurrying solvent, the remaining portion being subjected to distillation in step [II].

4. The brown coal liquefaction method according to claim 1, wherein the slurrying solvent for primary hydrogenation as recycled from step [V] is a middle distillate oil fraction, a heavy distillate oil fraction or a mixture thereof, each seprated from the scondary hydrogenation product.

5. The brown coal liquefaction method according to claim 1, wherein the slurrying solvent for primary hydrogenation as recycled from step [V] is a distillation residue separated from the secondary hydrogenation product and containing solvent-refined coal.

6. The brown coal liquefaction method according to claim 4, wherein the heavy distillate oil fraction contains solvent-refined coal.

7. The brown coal liquefaction method according to claim 1, wherein part of the naphtha fraction obtained from the primrary hydrogenation product, or of the naphtha fraction or a mixture thereof obtained from the secondary hydrogenation product is used as the deashing solvent thereby simultaneously removing benzene-insoluble components in the distillation residue.

8. The brown coal liquefaction method according to claim 1, wherein the slurrying solvent for ash removal to be used in step [IV] contains part of the middle distillate oil fraction, or the heavy distillate oil fraction or a mixture thereof, each obtained from the secondary hydrogenation product by distillation.

9. The brown coal liquefaction method according to claim 1, wherein the slurrying solvent for ash removal to be used in step [IV] has an aromatic carbon number index in the range of about 0.4 to 0.8.

10. The brown coal liquefaction method according to claim 1, wherein part of the medium distillate oil fraction obtained from the primary hydrogenation product, or the medium distillate oil fraction or a mixture thereof, obtained from the secondary hydrogenation product is added to the insoluble matter obtained by an ash-removing treatment and thereby reseparating said matter into a soluble fraction and an ash-containing insoluble fraction.

11. The brown coal liquefaction method according to claim 10, wherein the soluble fraction obtained by the reseparation is recycled to step [I] as the slurrying solvent.

12. The brown coal liquefaction method according to claim 10, wherein the insoluble fraction obtained by the reseparation is fed to a gasifying oven and hydrogen recovered from the resulting gas is used as the hydrogen for hydrogenation in step [I], step [IV] or both step [I] and step [IV].

13. The brown coal liquefaction method according to claim 2, wherein the temperature of said primary hydrogenation step is about 430° to 450° C. and said pressure is about 150 to 200 atmospheres.

14. The brown coal liquefaction method according to claim 2, wherein the temperature of said secondary hydrogenation step is about 360° to 420° C. and said pressure is about 100 to 150 atmospheres.

15. The brown coal liquefaction method according to claim 1, wherein said iron-based catalyst is a ($Fe_2O_3$+S) catalyst.

16. The brown coal liquefaction method according to claim 1, wherein said brown coal concentration is in the range of 25 to 35 percent by weight.

17. The brown coal liquefaction method according to claim l, wherein said iron-based catalyst is added in the amount of about 1 to 5 percent by weight.

18. The brown coal liquefaction method according to claim 1, wherein said molybdenum-based catalyst is Ni-Mo on alumina and Co-Mo on alumina.

* * * * *